US011845625B2

(12) United States Patent
Nukui et al.

(10) Patent No.: US 11,845,625 B2
(45) Date of Patent: Dec. 19, 2023

(54) FEEDING DEVICE AND IMAGE FORMING APPARATUS

(71) Applicant: FUJIFILM Business Innovation Corp., Tokyo (JP)

(72) Inventors: Tetsuo Nukui, Kanagawa (JP); Yuya Okawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/458,566

(22) Filed: Aug. 27, 2021

(65) Prior Publication Data

US 2022/0267107 A1 Aug. 25, 2022

(30) Foreign Application Priority Data

Feb. 25, 2021 (JP) ..... 2021-029186

(51) Int. Cl.
*B65H 3/06* (2006.01)
*B65H 5/00* (2006.01)

(52) U.S. Cl.
CPC ..... *B65H 3/0669* (2013.01); *B65H 5/006* (2013.01); *B65H 2403/51* (2013.01); *B65H 2403/53* (2013.01); *B65H 2801/06* (2013.01)

(58) Field of Classification Search
CPC .. B65H 3/0669; B65H 5/006; B65H 2403/51; B65H 2405/53; B65H 2801/06
See application file for complete search history.

(56) References Cited

U.S. PATENT DOCUMENTS 5,193,797 A * 3/1993 Harada ..... B65H 3/0669 271/118
5,882,002 A * 3/1999 Kamei ..... G03G 15/6511 271/118
2008/0143041 A1* 6/2008 Gladwin ..... B65H 3/0669 271/122
2016/0347560 A1* 12/2016 Murata ..... H04N 1/00588
2019/0092588 A1* 3/2019 Kikuchi ..... B65H 1/04
2019/0193970 A1 6/2019 Yamaguchi

FOREIGN PATENT DOCUMENTS

JP 2019112197 7/2019

* cited by examiner

*Primary Examiner* — Thomas A Morrison
(74) *Attorney, Agent, or Firm* — JCIPRNET

(57) ABSTRACT

A feeding device includes a stacked portion on which materials to be fed are stacked, a feeding roller that feeds the materials to be fed stacked on the stacked portion, a cam that performs first rotation in a state of being in contact with a mounting member on which the feeding roller is mounted and raises the feeding roller, an elastic member that lowers the raised feeding roller to the stacked portion while causing the cam that is in contact with the mounting member to perform second rotation with an elastic force acting on the mounting member, and an applying unit that applies a rotation resistance to the cam performing the second rotation.

5 Claims, 8 Drawing Sheets

FEEDING DEVICE AND IMAGE FORMING APPARATUS

CROSS-REFERENCE TO RELATED APPLICATIONS

This application is based on and claims priority under 35 USC 119 from Japanese Patent Application No. 2021-029186 filed Feb. 25, 2021.

BACKGROUND

(i) Technical Field

The present invention relates to a feeding device and an image forming apparatus.

(ii) Related Art

JP2019-112197A discloses a sheet transporting device that transports a sheet supported by a sheet supporting unit. The sheet transporting device includes an opening and closing member that is rotatable to a closed position and an opened position with respect to the sheet supporting unit, a flag member that is provided rotatably at the opening and closing member and is used for detecting the sheet on the sheet supporting unit, and an assisting member that is provided in the opening and closing member, is at a first position in a case where the opening and closing member is at the closed position and can be displaced to a second position from the first position due to the weight thereof in a case where the opening and closing member is at the opened position. In a case where the assisting member is positioned at the first position, the assisting member does not press the flag member, and in a case where the assisting member is positioned at the second position, the assisting member presses the flag member and biases the flag member to an opening and closing member side.

SUMMARY

As the feeding device, a feeding device including a stacked portion on which materials to be fed, such as paper, are stacked, a feeding roller that feeds the materials to be fed stacked on the stacked portion, and a cam that performs first rotation in a state of being in contact with a mounting member on which the feeding roller is mounted and raises the feeding roller is considered.

As the feeding device, a feeding device further including an elastic member that lowers the raised feeding roller to the stacked portion while causing the cam which is in contact with the mounting member to perform second rotation with an elastic force acting on the mounting member is considered.

In the feeding device, in a case where the raised feeding roller is lowered to the stacked portion, collision noise is generated in some cases as the feeding roller collides with the materials to be fed, which are stacked on the stacked portion, or the stacked portion.

Aspects of non-limiting embodiments of the present disclosure relate to a feeding device and an image forming apparatus that suppress collision noise generated in a case where the feeding roller is lowered to the stacked portion compared to a configuration where the cam performs second rotation without a resistance.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a feeding device including a stacked portion on which materials to be fed are stacked, a feeding roller that feeds the materials to be fed stacked on the stacked portion, a cam that performs first rotation in a state of being in contact with a mounting member on which the feeding roller is mounted and raises the feeding roller, an elastic member that lowers the raised feeding roller to the stacked portion while causing the cam that is in contact with the mounting member to perform second rotation with an elastic force acting on the mounting member, and an applying unit that applies a rotation resistance to the cam performing the second rotation.

BRIEF DESCRIPTION OF THE DRAWINGS

Exemplary embodiment(s) of the present invention will be described in detail based on the following figures, wherein.

DETAILED DESCRIPTION

Hereinafter, an example of an exemplary embodiment according to the present invention will be described based on the drawings.

Image Forming Apparatus 10

Figure 1:
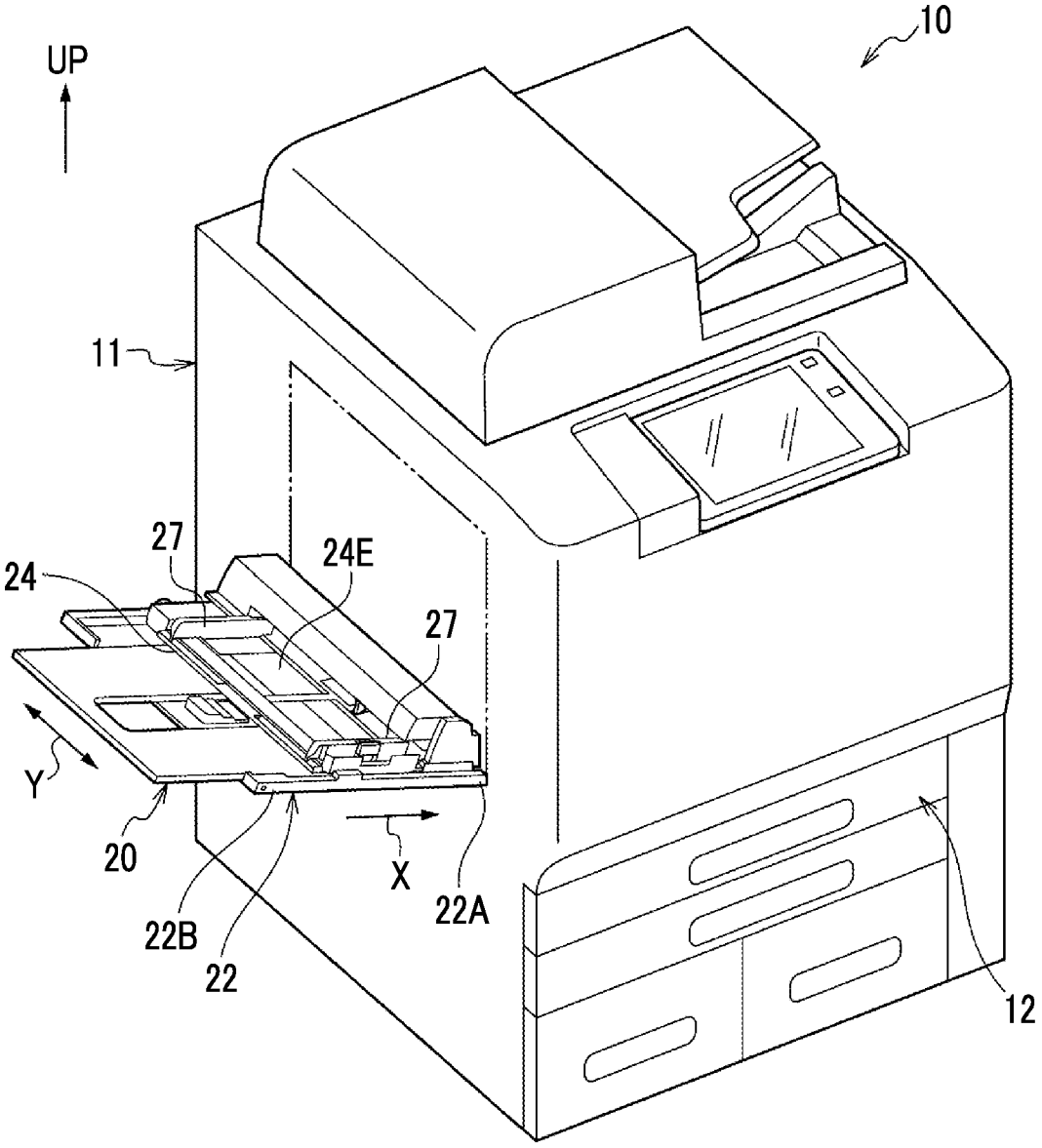
FIG. 1 is a perspective view illustrating an image forming apparatus according to the present exemplary embodiment.
Figure 2:
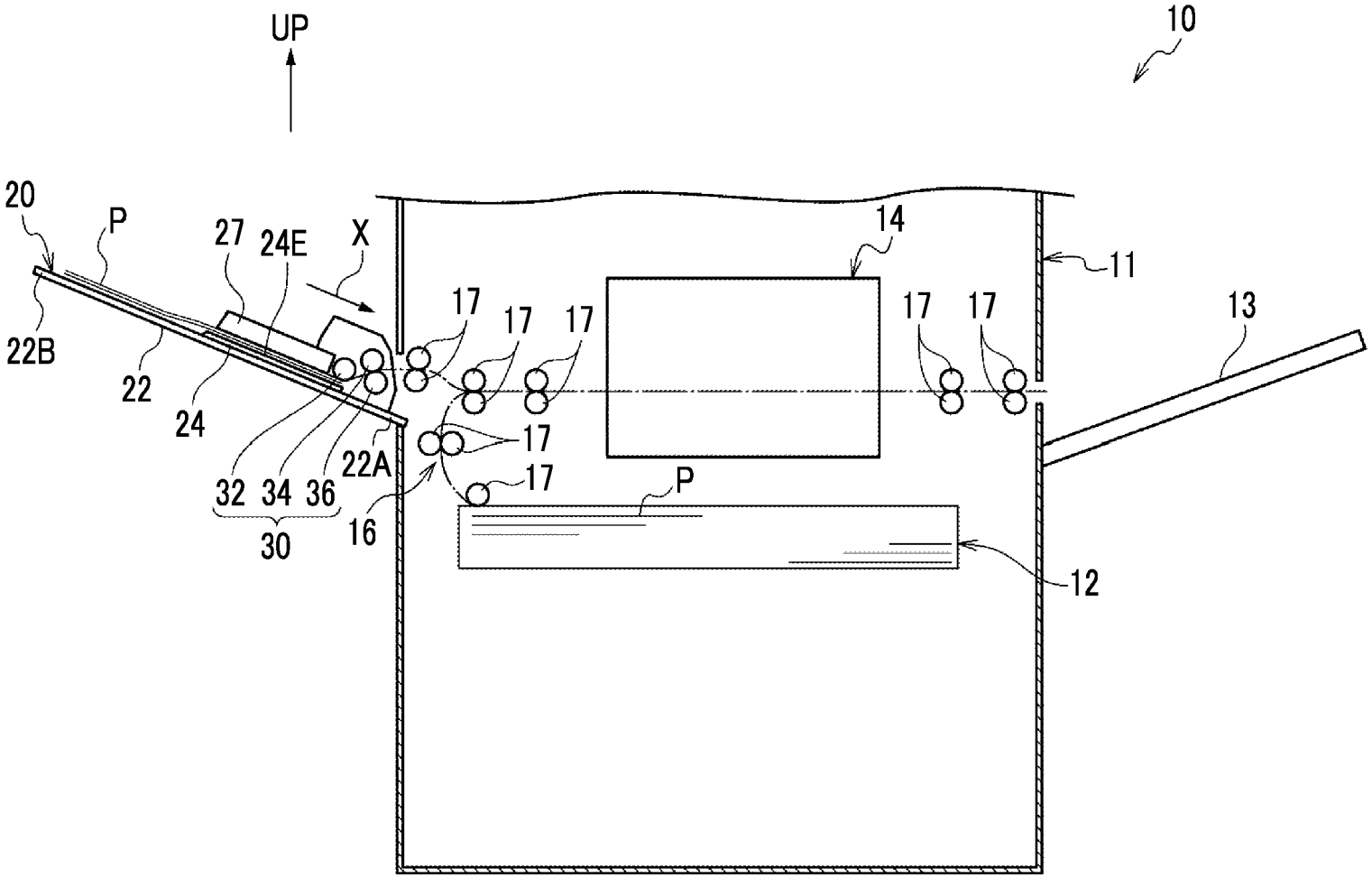
FIG. 2 is a regular cross-sectional view illustrating the image forming apparatus according to the present exemplary embodiment.

An image forming apparatus 10 according to the present exemplary embodiment will be described. FIG. 1 is a perspective view illustrating the image forming apparatus 10. FIG. 2 is a regular cross-sectional view illustrating the image forming apparatus 10. An arrow UP illustrated in each of the drawings including FIGS. 1 and 2 indicates an upper side (a vertically upper side) of the apparatus.

The image forming apparatus 10 illustrated in FIGS. 1 and 2 is an apparatus that forms an image. Specifically, as illustrated in FIGS. 1 and 2, the image forming apparatus 10 includes an image forming apparatus body 11, a medium accommodating unit 12, and a manual feeding tray 20. In addition, as illustrated in FIG. 2, the image forming apparatus 10 includes a medium discharged portion 13, an image forming unit 14, and a transporting mechanism 16. Hereinafter, each unit of the image forming apparatus 10 will be described.

Image Forming Apparatus Body 11

The image forming apparatus body 11 illustrated in FIGS. 1 and 2 is a portion where each configuration unit of the image forming apparatus 10 is provided. Specifically, as illustrated in FIG. 1, the image forming apparatus body 11 is configured by a housing formed in a substantially rectangular parallelepiped shape.

As illustrated in FIG. 2, in the present exemplary embodiment, for example, the medium accommodating unit 12, the image forming unit 14, and the transporting mechanism 16 are provided inside the image forming apparatus body 11. The manual feeding tray 20 is openably and closably mounted on one side surface of the image forming apparatus body 11. The medium discharged portion 13 is provided on the other side surface of the image forming apparatus body 11.

Medium Accommodating Unit 12

As illustrated in FIG. 2, the medium accommodating unit 12 of the image forming apparatus 10 is a portion that accommodates a recording medium P. The recording medium P accommodated in the medium accommodating unit 12 is supplied to the image forming unit 14. As the recording medium P, for example, paper P is used.

Medium Discharged Portion 13

The medium discharged portion 13 of the image forming apparatus 10, which is illustrated in FIG. 2, is a portion to which the recording medium P is discharged. The recording medium P on which an image is formed by the image forming unit 14 is discharged to the medium discharged portion 13.

Image Forming Unit 14

The image forming unit 14 illustrated in FIG. 2 has a function of forming an image on the recording medium P fed from the medium accommodating unit 12 and the manual feeding tray 20. Examples of the image forming unit 14 include an inkjet image forming unit that forms an image on the recording medium P using inks and an electrophotographic image forming unit that forms an image on the recording medium P using toners.

In the inkjet image forming unit, for example, ink droplets are jetted to the recording medium P from a jetting unit, and an image is formed on the recording medium P. The inkjet image forming unit may form an image on the recording medium P as the jetting unit jets ink droplets to a transfer body and the ink droplets are transferred from the transfer body to the recording medium P.

The electrophotographic image forming unit performs, for example, each of processes such as charging, exposing, developing, transferring, and fixing, and forms an image on the recording medium P. After the image is formed on the transfer body by performing each of the processes, such as charging, exposing, developing, and transferring, and the image is transferred from the transfer body to the recording medium P, the electrophotographic image forming unit may form the image on the recording medium P by fixing the image to the recording medium P.

Examples of the image forming unit are not limited to the inkjet image forming unit described above and the electrophotographic image forming unit described above, and various image forming units can be used.

Transporting Mechanism 16

The transporting mechanism 16 illustrated in FIG. 2 is a mechanism that transports the recording medium P. The transporting mechanism 16 transports the recording medium P, for example, with a transporting member 17 such as a transporting roller. The transporting member 17 may be a transporting belt, and may be any member that applies a transporting force to the recording medium P and can transport the recording medium P.

The transporting mechanism 16 transports the recording medium P from the medium accommodating unit 12 to the image forming unit 14. In addition, the transporting mechanism 16 transports the recording medium P fed from the manual feeding tray 20 to the image forming unit 14. Further, the transporting mechanism 16 transports the recording medium P from the image forming unit 14 to the medium discharged portion 13.

Manual Feeding Tray 20

Figure 3:
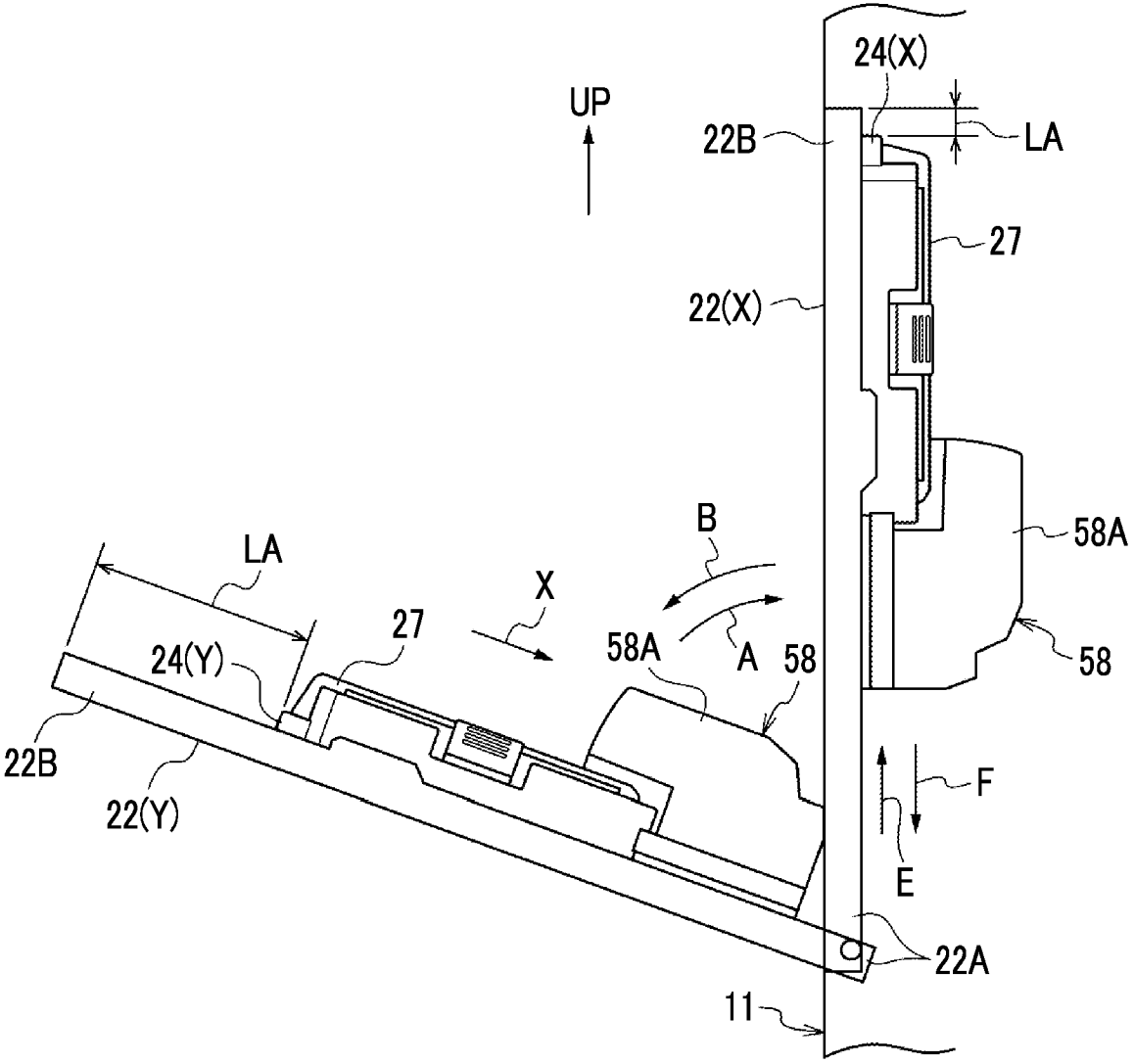
FIG. 3 is a side view illustrating an opening and closing operation of a manual feeding tray with respect to an image forming apparatus body according to the present exemplary embodiment.

FIG. 3 is a side view illustrating an opening and closing operation of the manual feeding tray 20 with respect to the image forming apparatus body 11. FIGS. 1 and 2 illustrate the manual feeding tray 20 in a state of being opened with respect to the image forming apparatus body 11.

As illustrated in FIG. 2, the manual feeding tray 20 of the image forming apparatus 10 is a portion on which the recording media P are stacked. The tray means a member on which the recording media P are stacked. Manual feeding means an operation of manually stacking the recording media P by a user of the image forming apparatus 10. Therefore, the manual feeding tray 20 means a member on which the recording media P are manually stacked by the user of the image forming apparatus 10.

In addition, as described above, the manual feeding tray 20 is provided outside the image forming apparatus body 11. On the manual feeding tray 20, the recording media P are stacked in a state of being exposed to the outside of the image forming apparatus body 11.

Further, the manual feeding tray 20 functions as, for example, a feeding device that feeds the recording medium P of a type which cannot be fed from the medium accommodating unit 12 or which is not appropriate for being fed from the medium accommodating unit 12. The type includes cardboard, postcards, envelopes, non-standard size paper, and resin films.

Specifically, as illustrated in FIG. 2, the manual feeding tray 20 includes a tray body 22, a stacked portion 24, and a feeding mechanism 30. The manual feeding tray 20 is an example of a "feeding device". The recording medium P is an example of a "material to be fed".

Tray Body 22

As illustrated in FIGS. 1 and 2, the tray body 22 is a portion where each configuration unit of the manual feeding tray 20 is provided. As illustrated in FIGS. 1 to 3, a downstream end portion 22A of the tray body 22 in a feeding direction (an arrow X direction in the drawings), in which the recording medium P is fed, is mounted on the image forming apparatus body 11. In the present exemplary embodiment, as illustrated in FIG. 3, an upstream end portion 22B of the tray body 22 is movable in a closing direction (an arrow A direction in FIG. 3) and an opening direction (an arrow B direction in FIG. 3) with the downstream end portion 22A as a fulcrum (that is, a rotation center).

That is, the tray body 22 is openable and closable between a closed position (a position indicated by a reference sign 22(X) in FIG. 3) where the upstream end portion 22B in the feeding direction is positioned above the downstream end portion 22A and an open position (a position indicated by a reference sign 22(Y) in FIG. 3 and a position illustrated in FIGS. 1 and 2) where the upstream end portion 22B is positioned on the side of the downstream end portion 22A. In addition, the tray body 22 may be configured such that the upstream end portion 22B is arranged at any position lower in the open position than in the closed position.

Stacked Portion 24

The stacked portion 24 is a portion on which the recording media P are stacked. As illustrated in FIGS. 1 to 3, the stacked portion 24 is provided on an inner side (a closing direction (the arrow A direction in FIG. 3) side of the tray body 22) of the tray body 22 movably along the tray body 22. Specifically, the stacked portion 24 is movable in a separating direction (an arrow E direction in FIG. 3) in which the stacked portion separates from the downstream end portion 22A (that is, the rotation center) of the tray body 22 to the upstream end portion 22B (that is, a free end) and an approaching direction (an arrow F direction in FIG. 3), which is an opposite direction thereof.

In the present exemplary embodiment, a link mechanism (not illustrated) moves the stacked portion 24 in the separating direction and the approaching direction in a movement range determined in advance with the opening and closing operation of the tray body 22. Specifically, the stacked portion 24 is positioned at a separated position (a position indicated by a reference sign 24(X) in FIG. 3) in a state where the tray body 22 is positioned at the closed position (hereinafter, referred to as "in the closed position of the tray body 22"), and moves from the separated position to an approached position (a position indicated by a reference sign 24(Y) in FIG. 3) in a case where the tray body 22 is rotated from the closed position to the open position. A distance LA between an upstream end of the stacked portion 24 and an upstream end of the tray body 22 is longer in a case where the stacked portion 24 is positioned at the separated position than in a case where the stacked portion is positioned at the approached position.

The stacked portion 24 is formed in a plate shape (flat shape) of which a thickness direction is the opening direction (the arrow B direction in FIG. 3) of the tray body 22. As illustrated in FIGS. 1 and 2, in a state where the tray body 22 is positioned at the open position (hereinafter, referred to as "in the open position of the tray body 22"), a stack surface 24E of the stacked portion 24, on which the recording media P are stacked, is exposed. Therefore, the recording media P are stacked on the stacked portion 24 in a state of being exposed to the outside of the image forming apparatus body 11.

Depending on the size of the recording medium P, there are a case where the entire recording medium P is stacked on the stacked portion 24 and a case where a part of the recording medium P is stacked on the stacked portion 24 and the other part is stacked on the tray body 22.

In addition, side guides 27 that come into contact with both side end portions of the recording media P stacked on the stacked portion 24, respectively, are provided on the stacked portion 24 (see FIG. 1). The side guides 27 are movable in a direction (hereinafter, referred to as an intersecting direction) intersecting (specifically, orthogonal to) the feeding direction. The intersecting direction is indicated by an arrow Y direction in each drawing.

Feeding Mechanism 30

The feeding mechanism 30 illustrated in FIG. 2 is a mechanism that feeds the recording medium P from the stacked portion 24. Specifically, the feeding mechanism 30 transports the recording medium P, which is fed from the stacked portion 24, to the image forming apparatus body 11. Therefore, the feeding mechanism 30 can also be called a supply mechanism that supplies the recording medium P to the image forming apparatus body 11. Specifically, the feeding mechanism 30 has a feeding roller 32, a transporting roller 34, an applying roller 36, a lifting mechanism 50 (see FIGS. 4 to 8), and a drive mechanism 38 (see FIG. 8).

Figure 4:
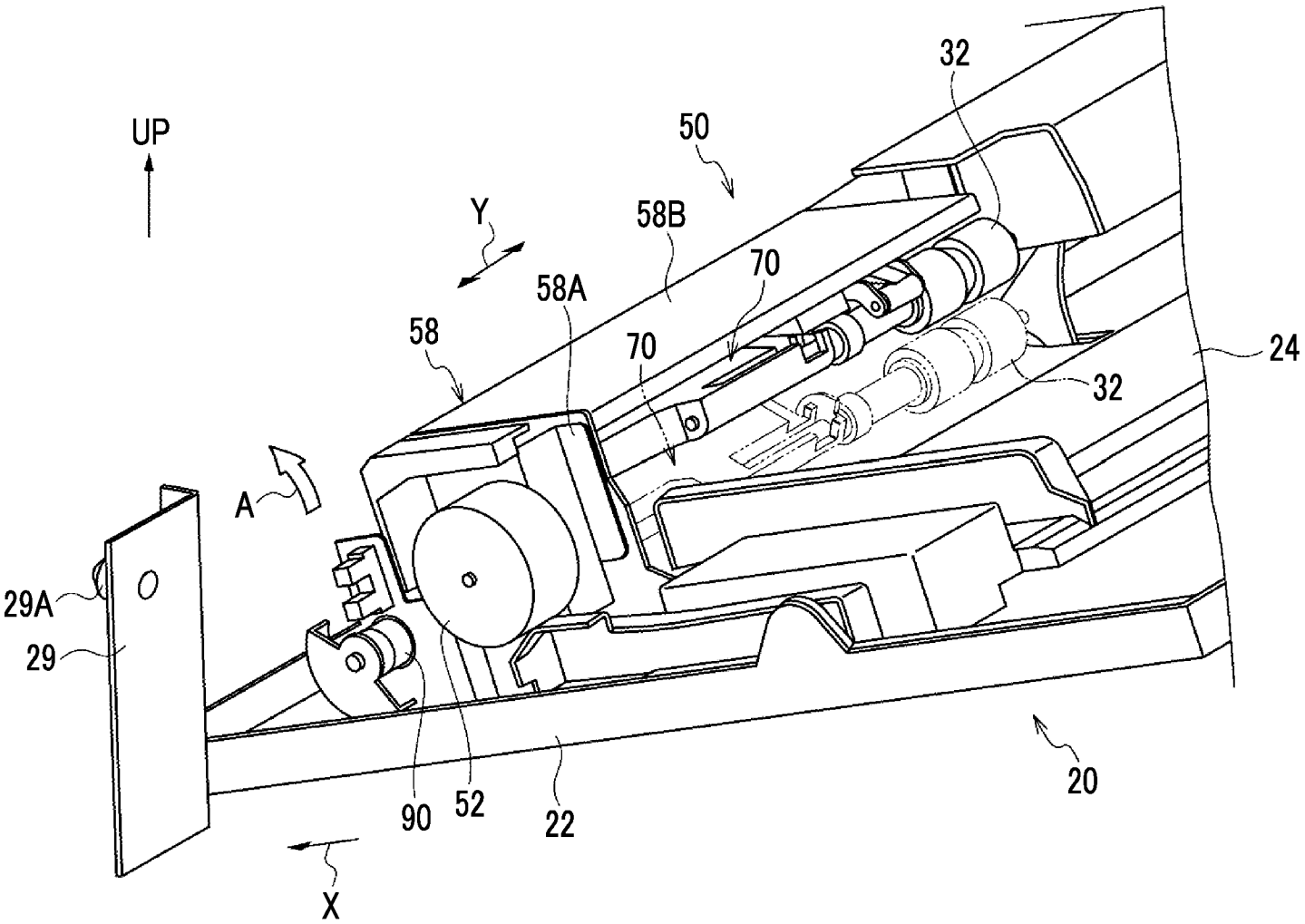
FIG. 4 is an enlarged perspective view illustrating a part of the manual feeding tray including a lifting mechanism according to the present exemplary embodiment.

As illustrated in FIG. 4, the lifting mechanism 50 can raise and lower the feeding roller 32 between a contact position (a position illustrated by a two-dot chain line in FIG. 4) of being in contact with the recording media P stacked on the stacked portion 24 and an upper position (a position illustrated by a solid line in FIG. 4), which is a position above the contact position. A specific configuration of the lifting mechanism 50 will be described later.

Specifically, the contact position is a position where the feeding roller 32 is in contact with a portion of the front surface of the recording medium P positioned uppermost, which is on downstream side in the feeding direction, among the recording media P stacked on the stacked portion 24. Therefore, the contact position can also be called a position where the feeding roller 32 has more approached to the stacked portion 24 than at the upper position. In a case where the recording media P are not stacked on the stacked portion 24, the feeding roller 32 at the contact position comes into contact with the stacked portion 24. As described above, the contact position is a position that changes according to the number (that is, the volume of the recording media P) of sheets of the recording media P stacked on the stacked portion 24. FIG. 2 illustrates the feeding roller 32 positioned at the contact position. In addition, the feeding roller 32 positioned at the contact position is illustrated by a solid line in FIG. 7.

Figure 6:
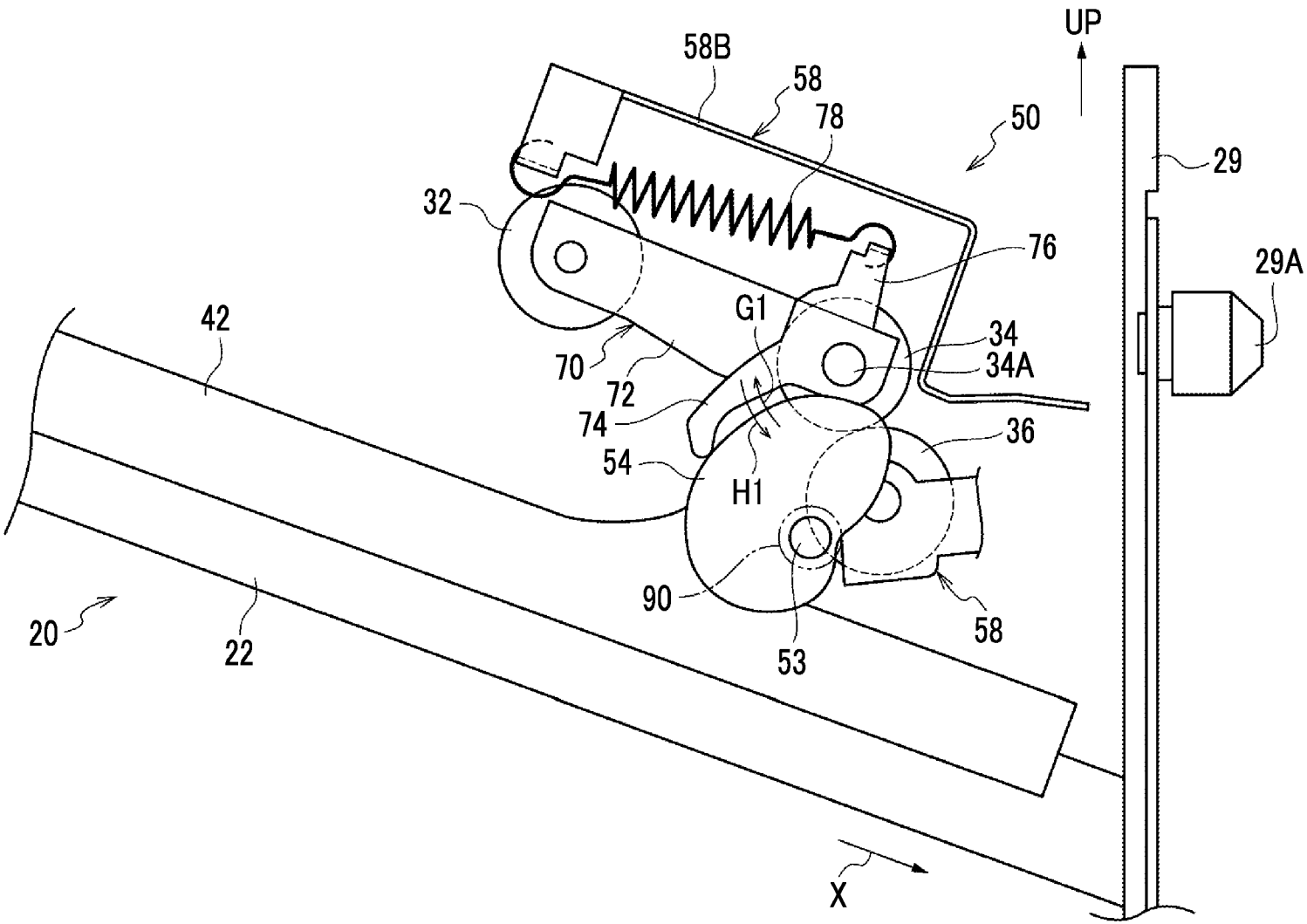
FIG. 6 is a side view illustrating the lifting mechanism in a state where a feeding roller according to the present exemplary embodiment is positioned at an upper position.

Specifically, the upper position is a position above the front surface of the recording medium P positioned uppermost in a case where the recording media P are stacked on the stacked portion 24 at a maximum stacked capacity thereof. Therefore, the upper position can also be called a position separated upward from the recording media P stacked on the stacked portion 24. FIG. 6 illustrates the feeding roller 32 positioned at the upper position. In addition, the feeding roller 32 positioned at the upper position is illustrated by a two-dot chain line in FIG. 7.

Figure 8:
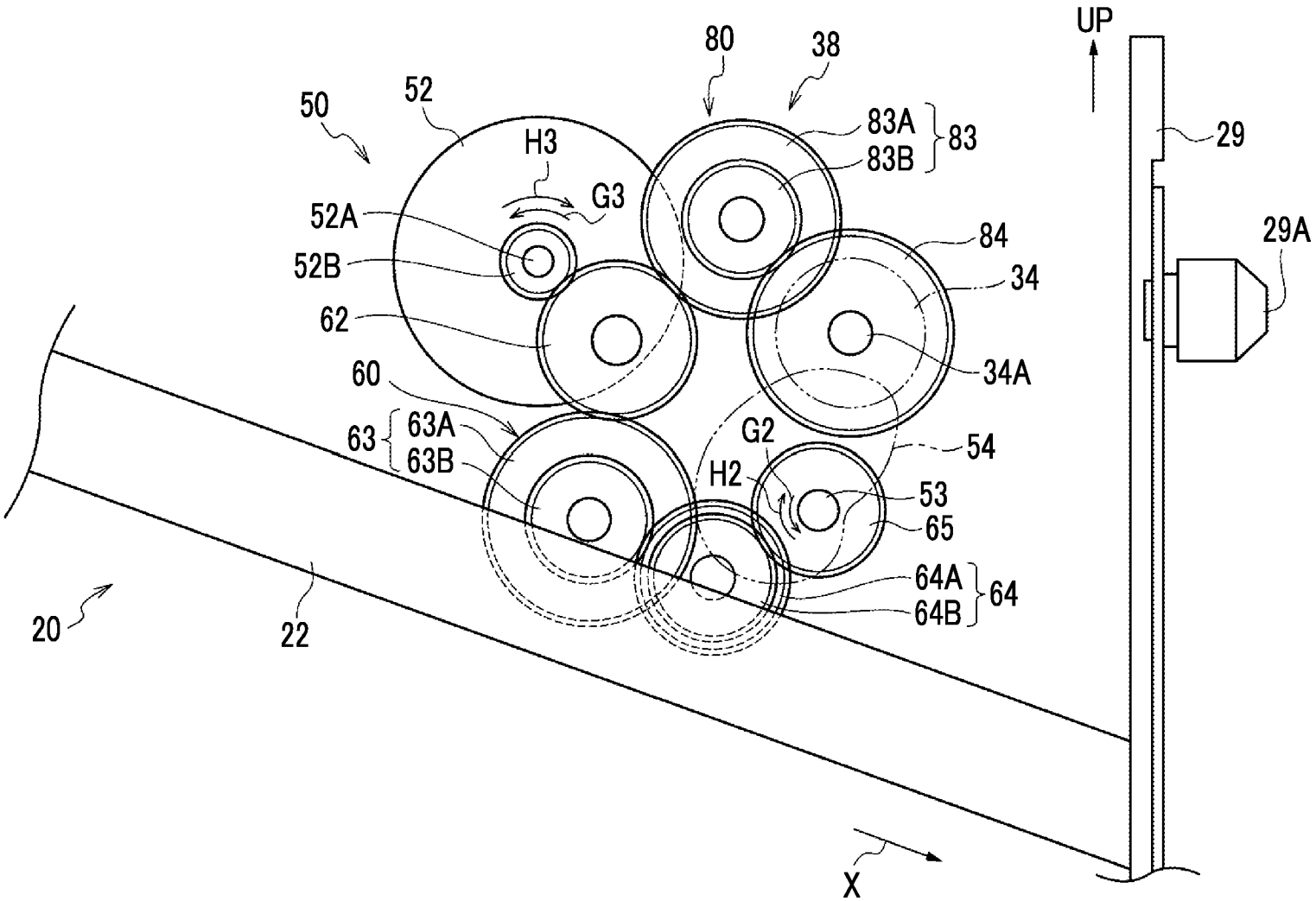
FIG. 8 is a side view illustrating the lifting mechanism and a drive mechanism according to the present exemplary embodiment.

At the contact position, the feeding roller 32 (see FIG. 2) feeds the recording medium P from the stacked portion 24 as being rotationally driven by the drive mechanism 38 (see FIG. 8). The feeding roller 32 is a roller which is also called a pickup roller or a nudger roller. A specific configuration of the drive mechanism 38 will be described later.

As illustrated in FIG. 2, the transporting roller 34 is arranged on the downstream side in the feeding direction with respect to the feeding roller 32. The applying roller 36 is arranged below the transporting roller 34, and is in contact with the transporting roller 34. As being rotationally driven by the drive mechanism 38, the transporting roller 34 further transports the recording medium P fed by the feeding roller 32 to the downstream side in the feeding direction. The transporting roller 34 is a roller which is also called a feed roller.

The applying roller 36 is a roller that is driven to rotate in a case where a rotational force determined in advance acts, and functions as a brake that generates a rotational load until the rotational force determined in advance acts. In a case where a plurality of recording media P overlap each other and are introduced between the transporting roller 34 and the applying roller 36, the applying roller 36 applies a transporting resistance from the back surface side of the recording medium P as the applying roller 36 functions as the brake as described above, preventing double feeding of the recording media P transported by the transporting roller 34. The applying roller 36 is a roller which is also called a retard roller.

In a case where the feeding mechanism 30 feeds the plurality of recording media P, which are overlapping each other, from the stacked portion 24 as described above, the transporting roller 34 applies a transporting force to the upper recording medium P (that is, the first recording medium P), while the applying roller 36 applies a transporting resistance to the lower recording medium P (the second and subsequent recording media P). That is, the sheets of paper P overlapping each other are separated (detached) by the transporting roller 34 and the applying roller 36, and the feeding mechanism 30 feeds the recording media P one by one.

Lifting Mechanism 50

Figure 5:
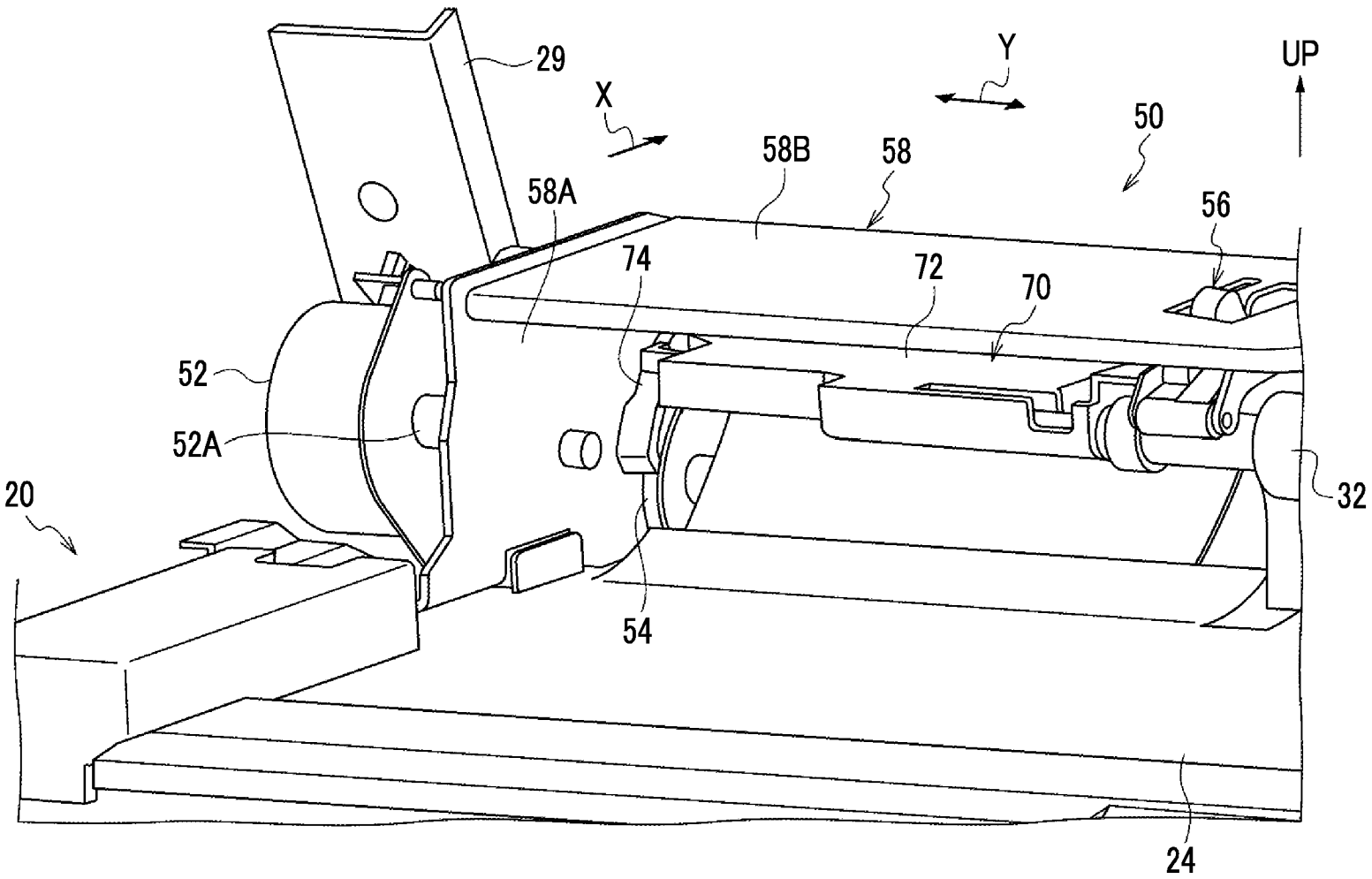
FIG. 5 is an enlarged perspective view illustrating a part of the manual feeding tray including the lifting mechanism according to the present exemplary embodiment.
Figure 7:
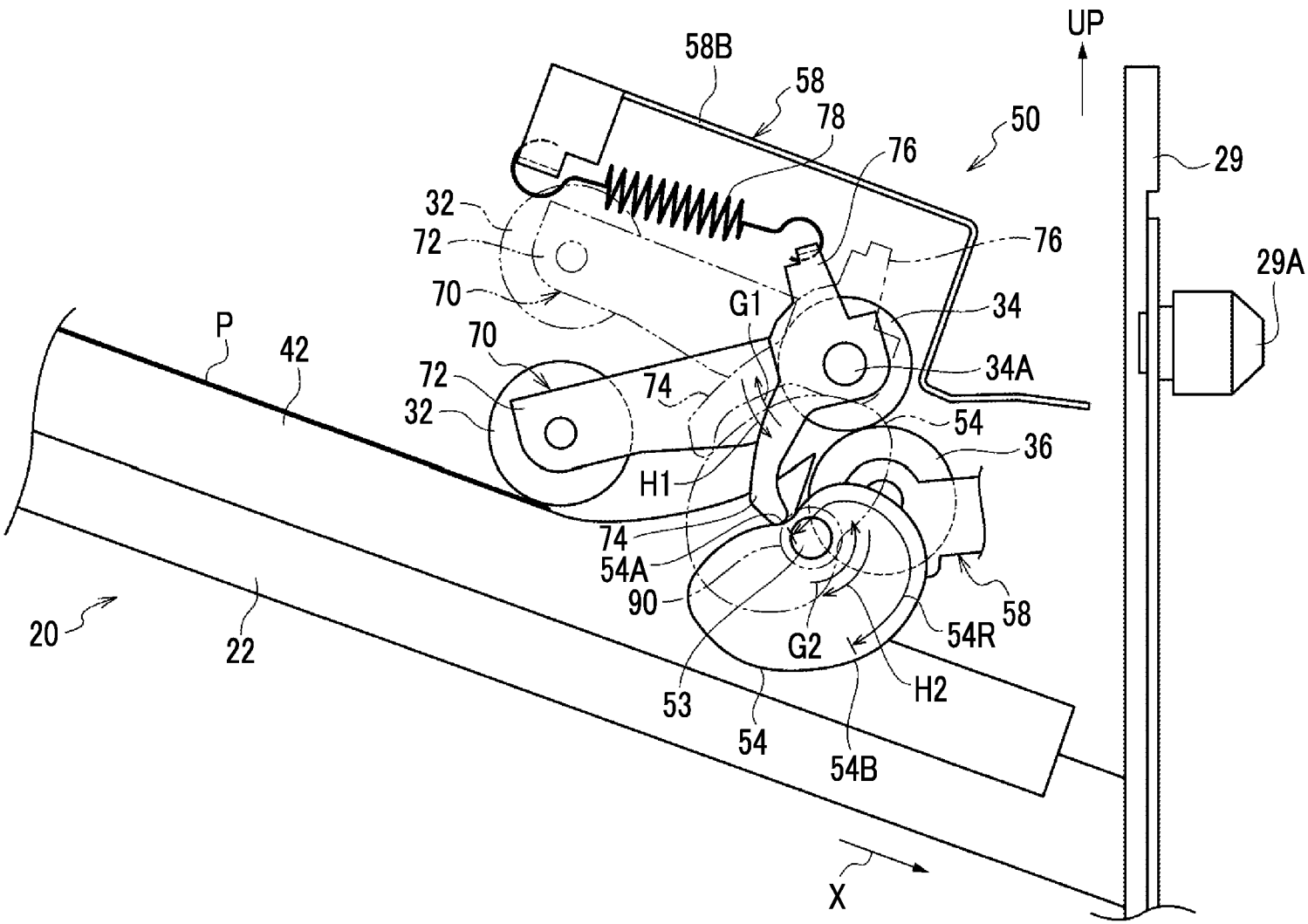
FIG. 7 is a side view illustrating the lifting mechanism in a state where the feeding roller according to the present exemplary embodiment is positioned at a contact position.

FIGS. 4 and 5 are enlarged perspective views illustrating a part of the manual feeding tray 20 including the lifting mechanism 50. FIG. 6 is a side view illustrating the lifting mechanism 50 in a state where the feeding roller 32 is positioned at the upper position. FIG. 7 is a side view illustrating the lifting mechanism 50 in a state where the feeding roller 32 is positioned at the contact position. FIG. 8 is a side view illustrating the lifting mechanism 50 and the drive mechanism 38.

The lifting mechanism 50 illustrated in FIGS. 4 to 8 is a mechanism that raises and lowers the feeding roller 32. Specifically, as illustrated in FIG. 5, the lifting mechanism 50 has a support body 58, a mounting member 70, a motor 52, and a holding unit 56. Further, the lifting mechanism 50 has a cam 54 (see FIGS. 6 and 7), a tension coil spring 78 (see FIGS. 6 and 7), and a gear train 60 (see FIG. 8).

In FIGS. 4 to 8, a mounting portion on which the image forming apparatus body 11 is mounted is indicated by a reference sign 29. Specifically, the mounting portion 29 is fixed to the image forming apparatus body 11 by screwing in a state where a pin 29A is inserted into the image forming apparatus body 11. The tray body 22 is configured to be rotatable with respect to the mounting portion 29.

Support Body 58

The support body 58 illustrated in FIGS. 4 to 7 has a function of supporting each configuration unit of the lifting mechanism 50. The support body 58 is fixed to the tray body 22. Specifically, for example, the support body 58 has a side wall 58A that extends from the tray body 22 in the closing direction (the arrow A direction (see FIGS. 3 and 4)) and an upper wall 58B that extends from an upper part of the side wall 58A in the intersecting direction (the arrow Y direction).

Mounting Member 70

As illustrated in FIGS. 6 and 7, the mounting member is a member on which the feeding roller 32 and the transporting roller 34 are rotatably mounted. That is, the mounting member 70 can also be called a supporting unit that rotatably supports the feeding roller 32 and the transporting roller 34.

Specifically, as illustrated in FIGS. 5 to 7, the mounting member 70 has a body 72, an arm portion 74, and a mounting portion 76. As illustrated in FIG. 5, the body 72 is configured by a member having a length in the intersecting direction. As illustrated in FIG. 6, in side view, the body 72 extends in the feeding direction (the arrow X direction). The feeding roller 32 is rotatably mounted on an upstream end portion of the body 72 in the feeding direction, and the transporting roller 34 is rotatably mounted on a downstream end portion of the body 72 in the feeding direction.

The arm portion 74 is arranged on one side of the body 72 in the intersecting direction, which is one side of the transporting roller 34 in the intersecting direction. In side view, the arm portion 74 extends obliquely downward to an upstream side in the feeding direction with respect to the transporting roller 34, and is arranged between the transporting roller 34 and the feeding roller 32 in the feeding direction.

The mounting portion 76 is a portion on which one end portion of the tension coil spring 78 is mounted. The mounting portion 76 extends upward from the downstream end portion of the body 72 in the feeding direction.

The mounting member 70 is rotatable in an arrow G1 direction and an arrow H1 direction, which is an opposite direction thereof, about a shaft portion 34A of the transporting roller 34 in the drawing. Specifically, the mounting member 70 is rotatable between a first position (hereinafter, referred to as a lowered position) where the feeding roller 32 is positioned at the contact position and a second position (hereinafter, referred to as a raised position) where the feeding roller 32 is positioned at the upper position.

FIG. 6 illustrates the mounting member 70 positioned at the raised position. In FIG. 7, the feeding roller 32 positioned at the upper position is illustrated by a two-dot chain line, and the feeding roller 32 positioned at the lowered position is illustrated by a solid line.

Tension Coil Spring 78

One end portion of the tension coil spring 78 is mounted on the mounting portion 76 of the mounting member 70, and the other end portion is mounted on the support body 58. Accordingly, the tension coil spring 78 pulls the feeding roller 32 in the arrow H1 direction (that is, a direction from the upper position toward the contact position) with an elastic force acting on the mounting member 70.

The tension coil spring 78 is an example of an elastic member. An example of the elastic member is not limited to the tension coil spring 78. The example of the elastic member may be a pressing spring such as a compression coil spring that presses the feeding roller 32 in the arrow H1 direction (that is, the direction from the upper position toward the contact position) with an elastic force acting on the mounting member 70, or any member that applies a force toward the arrow H1 direction to the feeding roller 32 with an elastic force acting on the mounting member 70.

Cam 54

As illustrated in FIG. 7, the cam 54 can normally rotate about a cam shaft 53 (that is, a rotation shaft) in an arrow G2 direction in the drawing, and can reversely rotate in an arrow H2 direction, which is an opposite direction of the arrow G2 direction. In addition, the cam 54 has a minor axis portion 54A and a major axis portion 54B. The radial length of the major axis portion 54B from the cam shaft 53 (that is, the rotation shaft) to an outer circumferential surface is larger than the radial length of the minor axis portion 54A. Normal rotation in the arrow G2 direction in the drawing is an example of "first rotation". Reverse rotation in the arrow H2 direction is an example of "second rotation".

The outer circumferential surface of the cam 54 comes into contact with the arm portion 74 in a contact range 54R (see FIG. 7) from the minor axis portion 54A to the major axis portion 54B. The contact range 54R is a range on an arrow H2 direction side from the minor axis portion 54A and on an arrow G2 direction side from the major axis portion 54B. The minor axis portion 54A is a portion of which the radial length from the cam shaft 53 to the outer circumferential surface is the shortest in the contact range 54R. The major axis portion 54B is a portion of which the radial length from the cam shaft 53 to the outer circumferential surface is the longest in the contact range 54R. In the contact range 54R, the radial length gradually increases from the minor axis portion 54A toward the major axis portion 54B.

As the minor axis portion 54A of the cam 54 comes into contact with the arm portion 74, the feeding roller 32 mounted on the mounting member 70 is positioned at the contact position. In a case where the cam 54, of which the minor axis portion 54A comes into contact with the arm portion 74, rotates normally in the arrow G2 direction and the major axis portion 54B of the cam 54 comes into contact with the arm portion 74, the feeding roller 32 moves from the contact position to the upper position. In a case where the cam 54, of which the major axis portion 54B comes into contact with the arm portion 74, rotates reversely in the arrow H2 direction and the minor axis portion 54A of the cam 54 comes into contact with the arm portion 74, the feeding roller 32 moves from the upper position to the contact position.

Holding Unit 56

The holding unit 56 illustrated in FIG. 5 has a function of holding the feeding roller 32 positioned at the upper position (a position illustrated in FIG. 6) at the upper position. The holding unit 56 is configured by a hook member (specifically, for example, a hook) provided at the support body 58. In a case where the mounting member 70 rotates in the arrow G1 direction from the lowered position to the raised position, in the holding unit 56, a hooked portion (not illustrated) provided at the mounting member 70 moves to a hooking position by the holding unit 56, and is hooked on the hooked portion. As the mounting member 70 moves to the raised position as described above, the holding unit 56 automatically holds the feeding roller 32, which is mounted on the mounting member 70, at the upper position. A releasing unit (not illustrated) releases the holding of the mounting member 70 by the holding unit 56 by moving the holding unit 56 from the hooking position.

Motor 52

As illustrated in FIGS. 4 and 5, the motor 52 is provided on the side wall 58A of the support body 58. The motor 52 is a drive source that generates a drive force rotating the cam 54 normally. As the motor 52, specifically, for example, a stepping motor is used.

The motor 52 is an example of a "driving unit". An example of the driving unit is not limited to the motor 52 configured by the stepping motor. An example of the driving unit may be a servomotor and other motors, or may be any driving unit that generates a drive force rotating the cam 54 normally.

The motor 52 configures a part of the lifting mechanism 50, and also configures a part of the drive mechanism 38 that drives the transporting roller 34 and the feeding roller 32 as will be described later.

Gear Train 60

The gear train 60 illustrated in FIG. 8 has a function of transmitting the drive force of the motor 52 to the cam 54. Specifically, as illustrated in FIG. 8, the gear train 60 is configured by a plurality of gears, and for example, has gears 62, 63, 64, and 65. The gear 62 meshes with a drive gear 52B provided on a drive shaft 52A of the motor 52.

For example, the gears 63 and 64 are configured by two-stage gears that have large-diameter gears 63A and 64A and small-diameter gears 63B and 64B having smaller diameters than the large-diameter gears 63A and 64A. The large-diameter gear 63A of the gear 63 meshes with the gear 62. The small-diameter gear 63B of the gear 63 meshes with the large-diameter gear 64A of the gear 64. The small-diameter gear 64B of the gear 64 meshes with the gear 65. The gear 65 is fixed to the cam shaft 53 of the cam 54. The gear 64 is a gear having a one-way clutch. While the gear transmits a rotational force from the motor 52 in a normal rotation direction (an arrow G3 direction) to the gear 65, a rotational force from the motor 52 in a reverse rotation direction (an arrow H3 direction) is not transmitted to the gear 65 due to the workings of the one-way clutch. Specifically, in a case where the gear 64 transmits the rotational force from the motor 52 in the reverse rotation direction from the gear 63, the large-diameter gear 64A idles with respect to the small-diameter gear 64B due to the workings of the one-way clutch.

In a case where the gear 64 has transmitted a rotational force from the cam 54 in the reverse rotation direction from the gear 65, the small-diameter gear 64B idles with respect to the large-diameter gear 64A due to the workings of the one-way clutch. In other words, the gear 64 does not transmit the rotational force from the cam 54 in the reverse rotation direction to the gear 63 due to the workings of the one-way clutch.

Workings of Lifting Mechanism 50

As described above, as illustrated in FIG. 8, as each of the gears 62, 63, 64, and 65 of the gear train 60 meshes with each other, a rotational force from the motor 52 in the normal rotation direction is transmitted to the cam 54 via the cam shaft 53 in the lifting mechanism 50. As the cam 54 to which the rotational force in the normal rotation direction is transmitted rotates normally in the arrow G2 direction as illustrated in FIG. 7 and the major axis portion 54B of the cam 54 comes into contact with the arm portion 74, the mounting member 70 rotates in the arrow G1 direction from the lowered position to the raised position. Accordingly, the feeding roller 32 mounted on the mounting member 70 rises from the contact position to the upper position. In a case where the mounting member 70 rotates from the lowered position to the raised position, the hooked portion (not illustrated) provided at the mounting member 70 moves to the hooking position by the holding unit 56, and is hooked on the holding unit 56. Accordingly, the holding unit 56 holds the feeding roller 32 at the upper position.

In a case where the holding of the mounting member 70 by the holding unit 56 is released by the releasing unit (not illustrated) in a state where the driving of the motor 52 is stopped, due to the elastic force of the tension coil spring 78, the cam 54 is rotated reversely in the arrow H2 direction with a state of being in contact with the arm portion 74 being maintained while the mounting member 70 is rotated from the raised position to the lowered position. Accordingly, the feeding roller 32 at the upper position lowers to the contact position. That is, due to the elastic force of the tension coil spring 78, the cam 54 which is in contact with the mounting member 70 is rotated reversely while the raised feeding roller 32 is lowered to the stacked portion 24. The elastic force of the tension coil spring 78 may at least act as a force lowering the feeding roller 32 at the upper position to the contact position, or may not act as a force rotating the cam 54 reversely. That is, the elastic force of the tension coil spring 78 may at least contribute to lowering the feeding roller 32 to the contact position, or may not contribute to rotating the cam 54 reversely.

For example, the releasing unit (not illustrated) performs a releasing operation based on a release command for releasing the holding of the mounting member 70 by the holding unit 56. The release command is generated, for example, by an execution command for executing an image forming operation.

Drive Mechanism 38

The drive mechanism 38 illustrated in FIG. 8 is a mechanism that rotationally drives the transporting roller and the feeding roller 32. Specifically, the drive mechanism 38 has the motor 52 described above and a gear train 80.

The gear train 80 has a function of transmitting the drive force of the motor 52 to the transporting roller 34. Specifically, as illustrated in FIG. 8, the gear train 80 is configured by a plurality of gears, and for example, has the gear 62 described above, and gears 83 and 84. As described above, the drive mechanism 38 has the motor 52 and the gear 62, which configure a part of the lifting mechanism 50. In other words, some configurations (the motor 52 and the gear 62 on the most upstream side of the gear trains 60 and 80) are common to the drive mechanism 38 and the lifting mechanism 50.

As described above, the gear 62 meshes with the drive gear 52B provided on the drive shaft 52A of the motor 52. For example, the gear 83 is configured by a two-stage gear that has a large-diameter gear 83A and a small-diameter gear 83B having a smaller diameter than the large-diameter gear 83A. The large-diameter gear 83A of the gear 83 meshes with the gear 62. The small-diameter gear 83B of the gear 83 meshes with the gear 84. The gear 84 is fixed to the shaft portion 34A (that is, a rotation shaft) of the transporting roller 34. The gear 83 is a gear having a one-way clutch. While the gear 83 transmits a rotational force from the motor 52 in the reverse rotation direction (the arrow H3 direction) to the gear 84, a rotational force from the motor 52 in the normal rotation direction (the arrow G3 direction) is not transmitted to the gear 84 due to the workings of the one-way clutch. Specifically, in a case where the gear 83 transmits the rotational force from the motor 52 in the normal rotation direction from the gear 62, the large-diameter gear 83A idles with respect to the small-diameter gear 83B due to the workings of the one-way clutch.

As the motor 52 rotates reversely in the reverse rotation direction, the drive mechanism 38 rotationally drives the transporting roller 34. In this case, as described above, in the lifting mechanism 50, the gear 64 does not transmit a rotational force from the motor 52 in the reverse rotation direction to the gear 65 due to the workings of the one-way clutch. Therefore, the cam 54 does not rotate.

The rotational force transmitted to the transporting roller 34 is further transmitted to the feeding roller 32 by a transmitting member (not illustrated), and the feeding roller 32 is rotationally driven. The transmitting member is configured by a belt and a gear.

Torque Limiter 90

A torque limiter 90 has a function of applying a rotation resistance to the reversely rotating cam 54. The torque limiter 90 is an example of an "applying unit".

The torque limiter 90 is arranged between the cam 54 and the gear 64 having the one-way clutch. That is, the cam 54 is arranged on the downstream side of the gear 64 in a transmitting direction of the drive force of the motor 52. Specifically, the torque limiter 90 is provided on the cam shaft 53 of the cam 54.

In the present exemplary embodiment, the torque limiter 90 applies a rotation resistance to the cam 54 in a case where the cam shaft 53 rotates with a torque that is equal to or lower than a set torque determined in advance. On the contrary, in a case where the cam shaft 53 rotates with a torque exceeding the set torque, the torque limiter 90 slides on the cam shaft 53, and the rotation resistance applied to the cam 54 decreases or the rotation resistance is not applied to the cam 54. The rotation of the cam shaft 53 herein includes normal rotation and reverse rotation.

As described above, in a case where the raised feeding roller 32 is lowered to the stacked portion 24 while the cam 54 is rotated reversely in the arrow H2 direction with a state of being in contact with the arm portion 74 maintained due to the elastic force of the tension coil spring 78, the cam shaft 53 rotates with a torque that is equal to or lower than the set torque. For this reason, the torque limiter 90 applies a rotation resistance to the cam 54.

On the other hand, in a case where a rotational force from the motor 52 in the normal rotation direction is transmitted to the cam 54 via the gear train 60 and the cam shaft 53, the cam shaft 53 rotates with a torque exceeding the set torque. Since the cam shaft 53 is rotated by the drive force of the motor 52 as described above, an effect of a rotation resistance applied by the torque limiter 90 to the cam shaft 53 is relatively low or negligible.

As a result, the torque limiter 90 applies a rotation resistance, which is lower than a rotation resistance applied to the reversely rotating cam 54, to the normally rotating cam 54, or does not apply a rotation resistance to the normally rotating cam 54.

Workings According to Present Exemplary Embodiment

In the configuration of the present exemplary embodiment, as described above, the raised feeding roller 32 is lowered to the stacked portion 24 while the cam 54 is rotated reversely in the arrow H2 direction with a state of being in contact with the arm portion 74 maintained, due to the elastic force of the tension coil spring 78 (see FIG. 7). Then, the torque limiter 90 applies a rotation resistance to the reversely rotating cam 54 via the cam shaft 53.

For this reason, collision noise generated in a case where the feeding roller 32 is lowered to the stacked portion 24 is suppressed compared to a configuration where the cam 54 rotates reversely without a resistance.

In addition, in the present exemplary embodiment, in a case where the feeding roller 32 is raised from the contact position to the upper position, a rotational force from the motor 52 in the normal rotation direction is transmitted to the cam 54 via the gear train 60 and the cam shaft 53. As the cam 54 to which the rotational force in the normal rotation direction is transmitted rotates normally in the arrow G2 direction as illustrated in FIG. 7 and the major axis portion 54B of the cam 54 comes into contact with the arm portion 74, the mounting member 70 rotates in the arrow G1 direction from the lowered position to the raised position. Accordingly, the feeding roller 32 mounted on the mounting member 70 rises from the contact position to the upper position. Then, the torque limiter 90 applies a rotation resistance, which is lower than a rotation resistance applied to the reversely rotating cam 54, to the normally rotating cam 54, or does not apply a rotation resistance to the normally rotating cam 54.

For this reason, the rotational force of the cam 54 necessary for raising the feeding roller 32 is smaller than a configuration where the torque limiter 90 applies the same rotation resistance as a rotation resistance, which is applied to the reversely rotating cam 54, to the normally rotating cam 54.

In addition, in the present exemplary embodiment, the torque limiter 90 is arranged between the cam 54 and the gear 64 having the one-way clutch. That is, the cam is arranged on the downstream side of the gear 64 in the transmitting direction of the drive force of the motor 52.

For this reason, upon reverse rotation of the cam 54, while the torque limiter 90 applies a rotation resistance to the cam 54, a rotational force generated by the reverse rotation of the cam 54 is not transmitted to the motor 52 due to the workings of the one-way clutch.

Further, in the present exemplary embodiment, specifically, the torque limiter 90 is provided on the cam shaft 53 of the cam 54. Hereinafter, since a rotation resistance is applied to the cam 54 via the transmitting member such as a gear in a configuration (hereinafter, referred to as a configuration A) where the torque limiter 90 is arranged on a rotation shaft (for example, a rotation shaft of a gear on the upstream side with respect to the cam 54) different from the cam shaft 53, a rotation resistance acts on the cam 54 varies in some cases.

On the other hand, since the torque limiter 90 is specifically provided on the cam shaft 53 of the cam 54 as described above in the present exemplary embodiment, a rotation resistance acting on the cam 54 is unlikely to vary compared to the configuration A.

MODIFICATION EXAMPLE

Although the cam 54 rotates reversely in the arrow H2 direction in a case where the feeding roller 32 at the upper position is lowered to the contact position in the present exemplary embodiment, without being limited thereto, the cam 54 may rotate normally in the arrow G2 direction in a case where the feeding roller 32 at the upper position is lowered to the contact position. In this case, the outer circumferential surface comes into contact with the arm portion 74 in a range from the major axis portion 54B of the cam 54 to the minor axis portion 54A in a clockwise direction in FIG. 7. Even in this case, the elastic force of the tension coil spring 78 may at least act as a force lowering the feeding roller 32 at the upper position to the contact position, or may not act as a force rotating the cam 54 normally. Further, in this case, a drive force rotating the cam 54 of the motor 52 normally may be applied to the cam 54. Therefore, in a case where the feeding roller 32 at the upper position is lowered to the contact position, it is possible to adopt a configuration where the normal rotation of the cam 54 is performed by at least one of an elastic force by the tension coil spring 78 or a drive force by the motor 52.

In addition, although the torque limiter 90 is used as an example of the applying unit in the present exemplary embodiment, the invention is not limited thereto. The example of the applying unit may be an elastic member such as a spring pressed by a member rotating with the rotation of the cam shaft 53 and the cam 54, or may be any applying unit that can apply a rotation resistance to the cam 54.

In addition, although a configuration where the torque limiter 90, which is an example of the applying unit, applies a rotation resistance, which is lower than a rotation resistance applied to the reversely rotating cam 54, to the normally rotating cam 54, or does not apply a rotation resistance to the normally rotating cam 54 is adopted in the present exemplary embodiment, the invention is not limited thereto. For example, a configuration applying the same rotation resistance as the rotation resistance, which is applied to the reversely rotating cam 54, to the normally rotating cam 54 may be adopted as an example of the applying unit. Therefore, a unit that does not change a rotation resistance applied to a member (the cam shaft 53 in the present exemplary embodiment), on which the applying unit is provided, regardless of a torque acting on the member may be adopted as an example of the applying unit.

In addition, as an example of the applying unit, an applying unit that applies a rotation resistance to the cam shaft 53 in a case where the cam 54 rotates reversely, idles with respect to the cam shaft 53 in a case where the cam 54 rotates normally, and applies a rotation resistance lower than the rotation resistance applied to the cam 54 or does not apply a rotation resistance to the cam 54 may be used. That is, a unit that switches between the presence and absence of application of a rotation resistance according to a rotation direction of the cam 54 may be adopted as the applying unit.

In addition, although the torque limiter 90, which is an example of the applying unit, is provided on the cam shaft 53 of the cam 54 in the present exemplary embodiment, the invention is not limited thereto. For example, the torque limiter 90 may be configured to be arranged on a rotation shaft (for example, the rotation shaft of the gear on the upstream side with respect to the cam 54) different from the cam shaft 53. In a case where the gear train 60 includes the gear 64 having the one-way clutch as in the present exemplary embodiment, the torque limiter 90 is arranged between the cam 54 and the gear 64 having the one-way clutch. That is, the cam 54 is arranged on the downstream side of the gear 64 in the transmitting direction of the drive force of the motor 52.

Although the paper P is used as the recording medium P, which is an example of the material to be fed, the invention is not limited thereto. For example, as an example of the recording medium P, for example, a resin film and a metal film may be used, or any recording medium that can be fed may be used. In addition, although the recording medium P on which an image is formed is used as an example of the material to be fed in the present exemplary embodiment, the invention is not limited thereto. For example, as an example of the material to be fed, a material to be fed, which is fed for the purpose of inspection and other processes instead of the purpose of performing a process of forming an image, or a material to be fed, which is fed for the exclusive purpose of transporting, may be used.

Although the manual feeding tray 20 is used as an example of the feeding device in the present exemplary embodiment, without being limited thereto, various feeding devices are applicable.

The present invention is not limited to the exemplary embodiment, and various modifications, changes, and improvements can be made without departing from the gist thereof. For example, the plurality of modification examples described above may be configured in combination as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding device comprising:

a stacked portion on which materials to be fed are stacked;

a feeding roller that feeds the materials to be fed stacked on the stacked portion;

a cam that performs first rotation in a state of being in contact with a mounting member on which the feeding roller is mounted and raises the feeding roller;

an elastic member that lowers the raised feeding roller to the stacked portion while causing the cam that is in contact with the mounting member to perform second rotation with an elastic force acting on the mounting member; and an applying unit that applies a rotation resistance to the cam performing the second rotation, wherein the applying unit is a torque limiter provided on a rotation shaft of the cam, and a center of the applying unit is aligned with a center of the rotation shaft, wherein a rotating direction of the second rotation is opposite to that of the first rotation.

2. The feeding device according to claim 1, wherein the applying unit applies a rotation resistance, which is lower than the rotation resistance applied to the cam performing the second rotation, to the cam performing the first rotation or does not apply a rotation resistance to the cam performing the first rotation.

3. The feeding device according to claim 1, further comprising:

a gear train that transmits a drive force from a driving unit, which causes the cam to perform the first rotation, to the cam; and a gear that is included in the gear train and idles upon the second rotation of the cam, wherein the applying unit is arranged between the cam and the gear.

4. The feeding device according to claim 2, further comprising:

a gear train that transmits a drive force from a driving unit, which causes the cam to perform the first rotation, to the cam; and a gear that is included in the gear train and idles upon the second rotation of the cam, wherein the applying unit is arranged between the cam and the gear.

5. An image forming apparatus comprising:

the feeding device according to claim 1 that is mounted on an image forming apparatus body; and an image forming unit that is provided in the image forming apparatus body and forms an image on a recording medium as a material to be fed, which is fed from the feeding device.

* * * * *